US012582239B2

(12) United States Patent
Xu et al.

(10) Patent No.: US 12,582,239 B2
(45) Date of Patent: Mar. 24, 2026

(54) MATTRESS AND BED

(71) Applicant: GREE ELECTRIC APPLIANCES, INC. OF ZHUHAI, Zhuhai (CN)

(72) Inventors: Chao Xu, Zhuhai (CN); Yingjiang Ma, Zhuhai (CN); Shicai Long, Zhuhai (CN); Yi Zhang, Zhuhai (CN); Ming Xie, Zhuhai (CN); Bowen Qiu, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 67 days.

(21) Appl. No.: 18/733,632

(22) Filed: Jun. 4, 2024

(65) Prior Publication Data

US 2024/0315465 A1 Sep. 26, 2024

Related U.S. Application Data

(63) Continuation-in-part of application No. PCT/CN2022/107994, filed on Jul. 26, 2022.

(30) Foreign Application Priority Data

Dec. 17, 2021 (CN) ..... 202111552629.3

(51) Int. Cl.
*A47C 27/08* (2006.01)
*A47C 27/10* (2006.01)

(52) U.S. Cl.
CPC ..... *A47C 27/081* (2013.01); *A47C 27/088* (2013.01); *A47C 27/10* (2013.01)

(58) Field of Classification Search
CPC ..... A47C 27/10; A47C 27/082; A47C 27/081; A47C 27/088; A61G 7/05776
See application file for complete search history.

(56) References Cited

U.S. PATENT DOCUMENTS 4,745,647 A * 5/1988 Goodwin ..... A61G 7/0513 D12/132
4,953,247 A * 9/1990 Hasty ..... A61G 7/05776 137/625.68

(Continued)

FOREIGN PATENT DOCUMENTS

CN 1036319 A * 10/1989
CN 101803842 A 8/2010

(Continued)

OTHER PUBLICATIONS

International Search Report and Written Opinion mailed Oct. 27, 2022, issued in corresponding International Application No. PCT/CN2022/107994, filed Jul. 26, 2022, 14 pages.

*Primary Examiner* — Eric J Kurilla
(74) *Attorney, Agent, or Firm* — Christensen O'Connor Johnson Kindness PLLC

(57) ABSTRACT

A mattress and a bed. The mattress comprises: a support layer assembly (10), wherein the support layer assembly (10) is embedded with a pipe channel (11); an airbag assembly (20), wherein the airbag assembly (20) is located on the support layer assembly (10); and a pipe assembly (30), wherein the pipe assembly (30) is arranged at least partially passing through the pipe channel (11) and is in communication with the airbag assembly (20). The mattress and the bed effectively solve the problem of poor comfort of a mattress due to the fixation of an air pipe in the related art.

16 Claims, 12 Drawing Sheets

(56) References Cited

U.S. PATENT DOCUMENTS

| | | | | | |
|---|---|---|---|---|---|
| 5,062,171 | A * | 11/1991 | Vrzalik | A61G 7/001 | 5/713 |
| 5,065,466 | A * | 11/1991 | Thomas | A61G 7/05776 | 5/713 |
| 5,095,568 | A * | 3/1992 | Thomas | A61G 7/001 | 5/713 |
| 5,619,764 | A * | 4/1997 | Lopau | A61G 7/05776 | 5/713 |
| 5,634,225 | A * | 6/1997 | Miller, Sr. | A61G 7/05776 | 5/713 |
| 5,918,336 | A * | 7/1999 | Lee | A61G 7/05776 | 5/713 |
| 2007/0044240 | A1* | 3/2007 | Chen Han | A61G 7/05776 | 5/655.3 |
| 2008/0040860 | A1* | 2/2008 | Price | A61G 7/05776 | 128/845 |
| 2008/0201858 | A1* | 8/2008 | Caminade | F16K 31/0651 | 5/713 |
| 2012/0317720 | A1 | 12/2012 | Chiang et al. | | |
| 2013/0000047 | A1* | 1/2013 | McCann | A47C 27/128 | 5/709 |
| 2018/0160821 | A1* | 6/2018 | Chapin | A47C 27/083 | |
| 2018/0344046 | A1* | 12/2018 | DeFranks | A47C 21/042 | |
| 2021/0000669 | A1* | 1/2021 | Meyer | A61G 7/053 | |

FOREIGN PATENT DOCUMENTS

| | | | | | |
|---|---|---|---|---|---|
| CN | 206182821 | U | | 5/2017 | |
| CN | 207898287 | U | | 9/2018 | |
| CN | 210542286 | U | | 5/2020 | |
| CN | 111227563 | A | * | 6/2020 | A47C 27/056 |
| CN | 212280698 | U | * | 1/2021 | |
| CN | 113303625 | A | | 8/2021 | |
| CN | 114010002 | A | | 2/2022 | |
| CN | 216494478 | U | | 5/2022 | |
| CN | 216494491 | U | | 5/2022 | |
| DE | 102004013674 | A1 | * | 10/2005 | B60N 2/914 |
| EP | 2535029 | A1 | | 12/2012 | |
| JP | 2000325417 | A | * | 11/2000 | |
| WO | WO-2004041144 | A1 | * | 5/2004 | A61H 9/0078 |

* cited by examiner

MATTRESS AND BED

CROSS-REFERENCE TO RELATED APPLICATIONS

This application is a continuation in part of international patent application No. PCT/CN2022/107994 filed on Jul. 26, 2022, which itself claims priority to China Patent Application No. 202111552629.3, filed on Dec. 17, 2021, titled "MATTRESS AND BED", the content of which is hereby incorporated by reference in its entirety.

TECHNICAL FIELD

The present disclosure relates to the technical field of beds, and in particular, to a mattress and a bed.

BACKGROUND

With the improvement of people's living standards and the development of network technology, the concept of smart home has become more and more mature, including a variety of home appliances or smart home products, such as air conditioners, refrigerators, TVs, mobile phones, rice cookers, smart gateways, etc. The smart home products all have WiFi modules, temperature and humidity sensors, etc., which constitute the overall ecological environment of the smart home.

As the most central component in furniture, beds are also gradually developing and evolving towards intelligence. Modules such as smart Bluetooth modules and speakers are being integrated into smart beds. Including airbag assemblies to enable different functions becomes one of the hot features of current smart beds.

In related art, an airbag in the smart bed is laid on the mattress, and the air tube in communication with the airbag is disposed on a support layer, and fixed to the mattress by an air tube clamp. Since the air tube clamp that fixes the air tube is larger in volume than the air tube, the human body can easily feel the presence of the air tube clamp, which affects sleep experience.

SUMMARY

The present disclosure provides a mattress and a bed.

In a first aspect, the present disclosure provides a mattress, including: a support layer assembly including pipeline channels embedded therein; an airbag assembly located on the support layer assembly; a pipeline assembly at least partially extending through the pipeline channels and in communication with the airbag assembly.

In some embodiments, the support layer assembly includes a sponge support layer. The pipeline channels are disposed in the sponge support layer.

In some embodiments, the pipeline channel includes a plurality of longitudinal holes. The plurality of longitudinal holes extend in a length direction of the mattress, and are arranged in sequence in a width direction of the mattress.

In some embodiments, a longitudinal slit is defined between each of the plurality of longitudinal holes and a top surface of the sponge support layer.

In some embodiments, the pipeline assembly includes a plurality of air outlet tubes disposed in the plurality of longitudinal holes in one-to-one manner.

In some embodiments, the pipeline assembly further includes an air inlet tube and a valve. The air inlet tube is connected to an air inlet of the valve. A first end of each of the plurality of air outlet tubes is connected to an air outlet of the valve, and a second end of each of the plurality of air outlet tubes is connected to the airbag assembly.

In some embodiments, the support layer assembly includes a support layer body located at a side of the sponge support layer away from the airbag assembly. The support layer body includes an accommodating space. The valve is disposed in the accommodating space.

In some embodiments, the valve includes one air inlet and a plurality of air outlets. The plurality of air outlet tubes are connected to the plurality of air outlets in one-to-one manner.

In some embodiments, the valve abuts against the support layer assembly such that the plurality of air outlets of the valve are located in the plurality of longitudinal holes respectively.

In some embodiments, an axis of the air inlet of the valve is perpendicular to an axis of each of the plurality of air outlets of the valve.

In some embodiments, the plurality of air outlet tubes is in interference fit with the plurality of longitudinal holes respectively.

In some embodiments, the mattress further includes an airbag support layer disposed between the support layer assembly and the airbag assembly.

In some embodiments, the airbag assembly includes a plurality of airbags extending in a length direction of the mattress. Predetermined distances are formed between air inlet nozzles of the plurality of airbags in a width direction of the mattress.

In some embodiments, a plurality of airbag assembly are provided, and a plurality of pipeline assembly corresponding to the plurality of airbag assembly are provided.

In a second aspect, the present disclosure provides a bed, including the mattress according to any one of the above embodiments.

BRIEF DESCRIPTION OF THE DRAWINGS

The accompanying drawings, which are incorporated in and constitute a part of this specification, illustrate embodiments consistent with the present disclosure, and serve to explain the principles of the present disclosure in conjunction with the description.

In order to more clearly illustrate the technical schemes in the embodiments of the present disclosure or related art, the drawings for describing the embodiments or related art will be briefly introduced below. Apparently, for those of ordinary skill in the art, other drawings can also be obtained based on these drawings without any creative effort.

Figure 1:
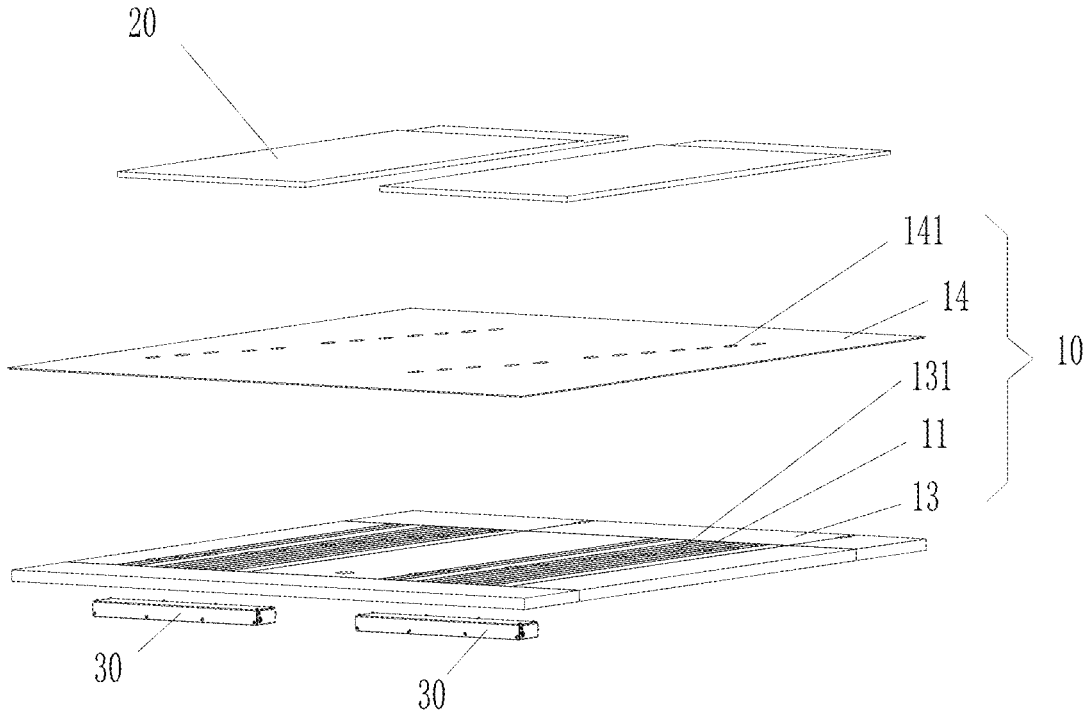
FIG. 1 is an exploded schematic structural view of a mattress according to an embodiment of the present disclosure.
Figure 2:
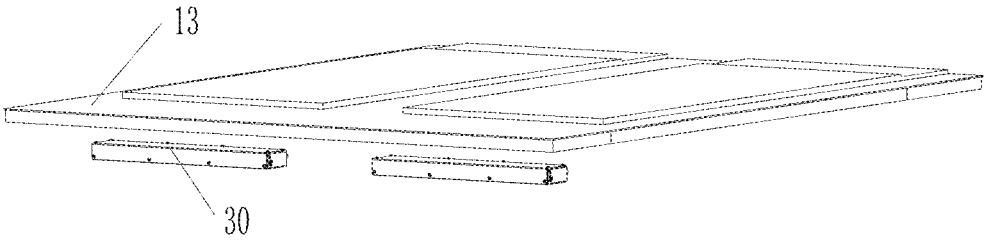
FIG. 2 is a schematic positional view of a valve of a pipeline assembly and a sponge support layer of the mattress of FIG. 1.
Figure 3:
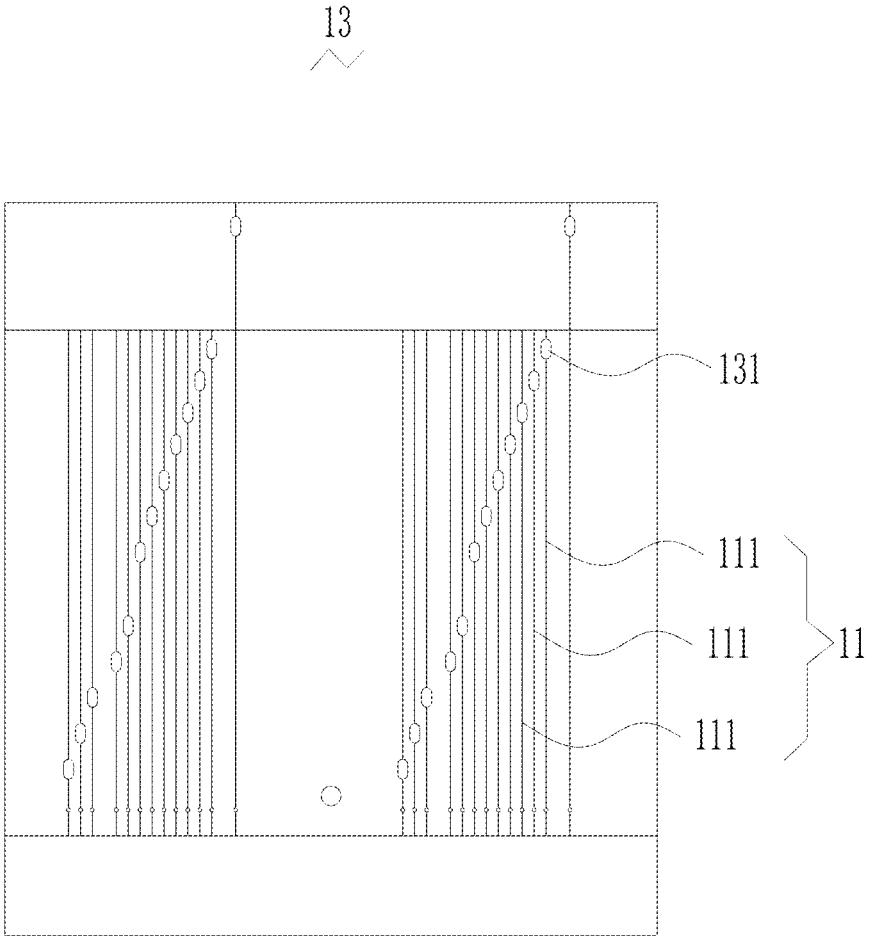
FIG. 3 is a schematic top view of the sponge support layer of the mattress of FIG. 1.
Figure 4:
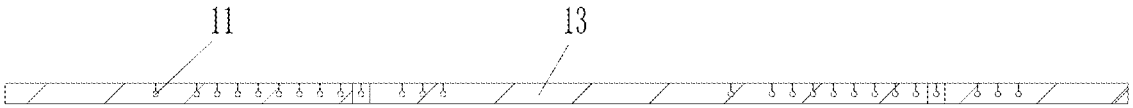
FIG. 4 is a schematic cross-sectional view of the sponge support layer of FIG. 3.

The above figures include the following reference signs: 10, Support layer assembly; 11, Pipeline channel; 111, Longitudinal hole; 112, Longitudinal slit; 12, Accommodating space; 13, Sponge support layer; 131, First through hole; 14, Airbag support layer; 141, Second through hole; 15, Support layer body; 20, Airbag assembly; 21, Airbag; 30, Pipeline assembly; 31, Air inlet tube; 32, Valve; 321, solenoid valve; 322, air inlet; 323, air outlet; 33, air outlet tube; 34, elbow.

DETAILED DESCRIPTION OF THE EMBODIMENTS

In order to make the object, technical schemes and advantages of the embodiments of the present disclosure clearer, the technical schemes in the embodiments of the present disclosure will be clearly and completely described below in conjunction with the drawings in the embodiments of the present disclosure. Apparently, the described embodiments are part of the embodiments of the present disclosure, but not all of the embodiments. Based on the embodiments in this disclosure, all other embodiments obtained by those of ordinary skill in the art without any creative efforts fall within the scope of protection of this disclosure.

As shown in FIGS. 1 to 7, in an embodiment, a mattress includes a support layer assembly 10, an airbag assembly 20, and a pipeline assembly 30. The support layer assembly 10 includes pipeline channels 11 embedded therein. The airbag assembly 20 is located on the support layer assembly 10. The pipeline assembly 30 at least partially extends through the pipeline channels 11 and in communication with the airbag assembly 20.

In the technical scheme according to the present disclosure, the airbag assembly 20 is located on the support layer assembly 10, the pipeline channels 11 are embedded in the support layer assembly 10, and the pipeline assembly 30 at least partially extends through the pipeline channels 11. The pipeline assembly 30 having the above structure does not need to be disposed on the support layer assembly 10 and fixed through an air tube clamp. In this way, there is no need to dispose the air tube clamp with a large volume in the mattress, and the human body will have a better feeling. The technical scheme of the present disclosure effectively solves the problem in the related art of reduced comfort of the mattress due to the fixation of the air tube.

As shown in FIGS. 8 to 12, in the technical scheme of the present embodiment, the support layer assembly 10 is further provided with an accommodating space 12 in communication with the pipeline channels 11. The pipeline assembly 30 includes an air inlet tube 31, a valve 32, and air outlet tubes 33. The air inlet tube 31 is connected to an air inlet 322 of the valve 32. First ends of the air outlet tubes 33 are connected to air outlets 323 of the valve 32, second ends of the air outlet tubes 33 are connected to the airbag assembly 20. The valve 32 is disposed in the accommodating space 12. The arrangement of the valve 32 can well control air intake factors, such as air intake volume, air intake pressure, or opening and closing of each air outlet branch.

Figure 8:
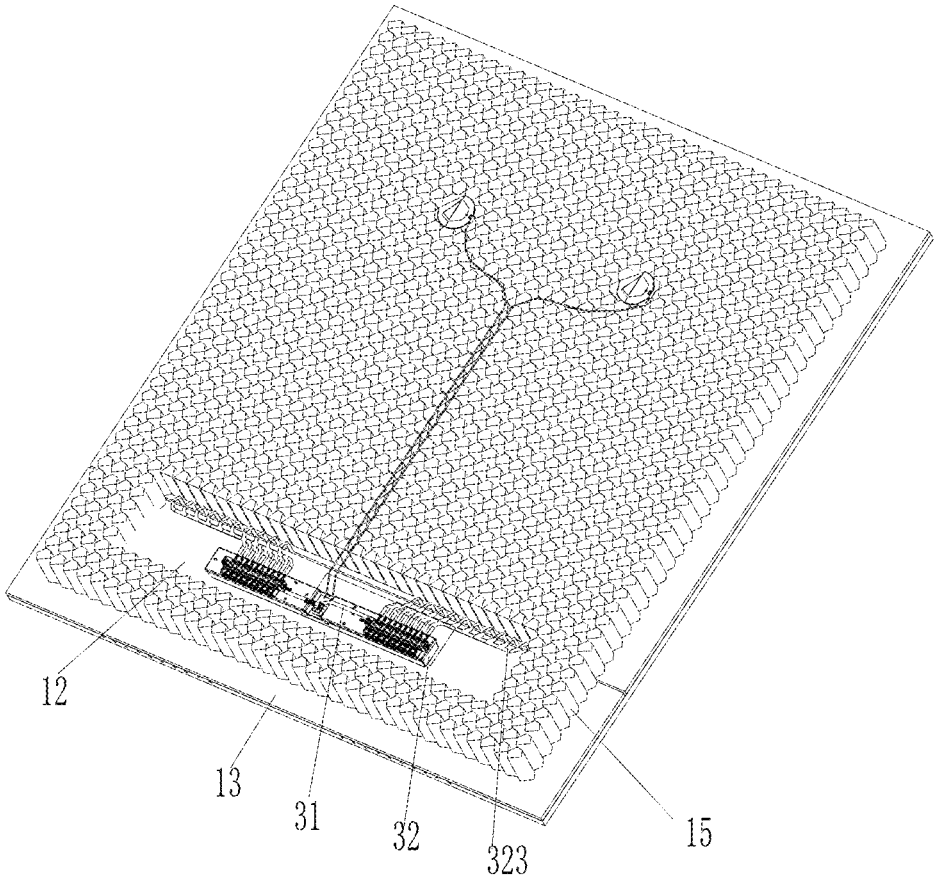
FIG. 8 is a schematic structural view of a combination of a sponge support layer and a support layer body according to an embodiment of the present disclosure.

As shown in FIG. 8, in the technical scheme according to the present embodiment, the support layer assembly 10 includes a support layer body 15. The accommodating space 12 is located in the support layer body 15. Such configuration imparts a better feeling to the human body. Specifically, the support layer body 15 can be a hard sponge, or a pocketed spring assembly. When the support layer body 15 is the hard sponge, a portion of the hard sponge is hollowed out to form the accommodating space. The mattress in the present embodiment is a bed mattress, and the accommodating space is located near the foot end of the mattress. As another possible implementation, the accommodating space 12 can be directly located in a sponge support layer 13. For example, the accommodating space 12 is located near the foot end of the sponge support layer. It should be noted that an opening of the accommodating space can face upward, and another cushion layer need to be laid on the upper surface to make the body feel more comfortable. The opening of the accommodating space can face downward. The beneficial effect of such configuration is that the center of the valve 32 can be easily flush with the center of the air outlet tubes 33. When the support layer body 15 is the pocketed spring assembly, the accommodating space for the valve 32 needs to be emptied, and that is, no pocketed spring is disposed in the accommodating space.

Figure 9:
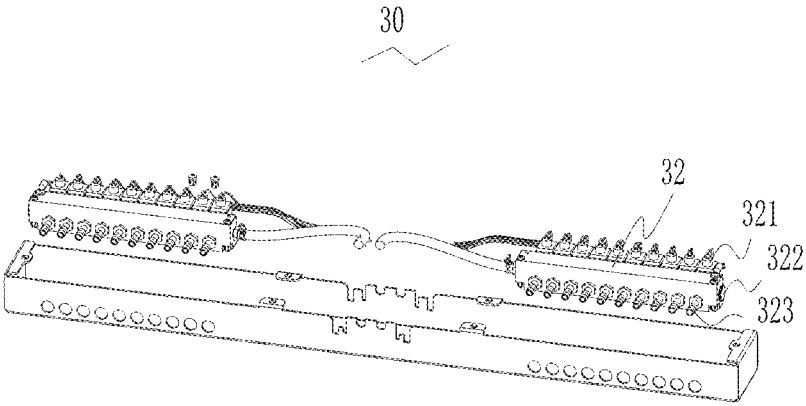
FIG. 9 is a schematic structural view of a pipeline assembly according to an embodiment of the present disclosure.
Figure 10:
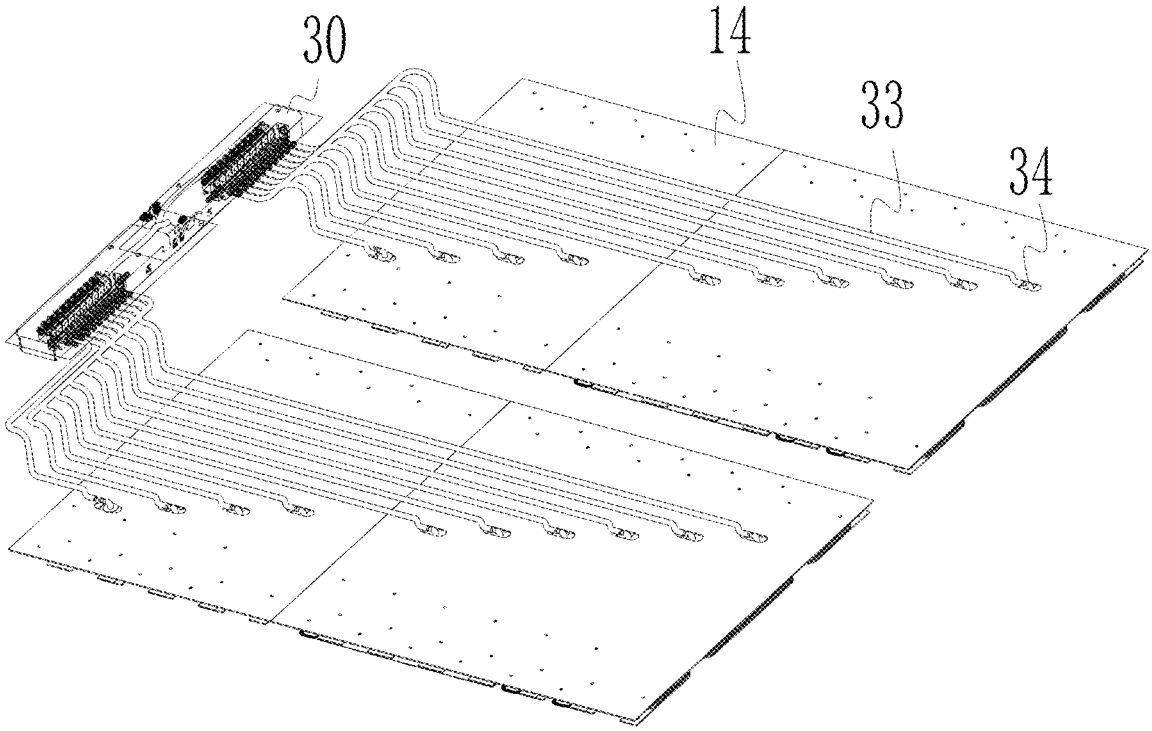
FIG. 10 is a schematic structural view of a pipeline assembly extending through an airbag support layer according to an embodiment of the present disclosure.
Figure 11:
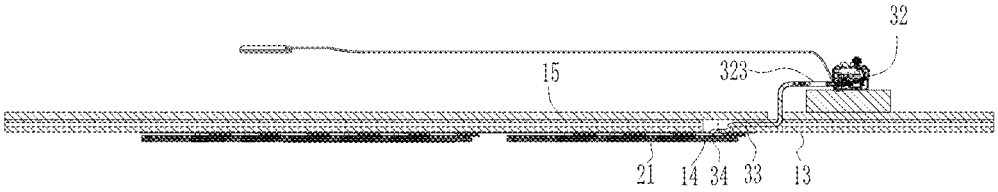
FIG. 11 is a sectional view of a mattress according to an embodiment of the present disclosure.
Figure 12:
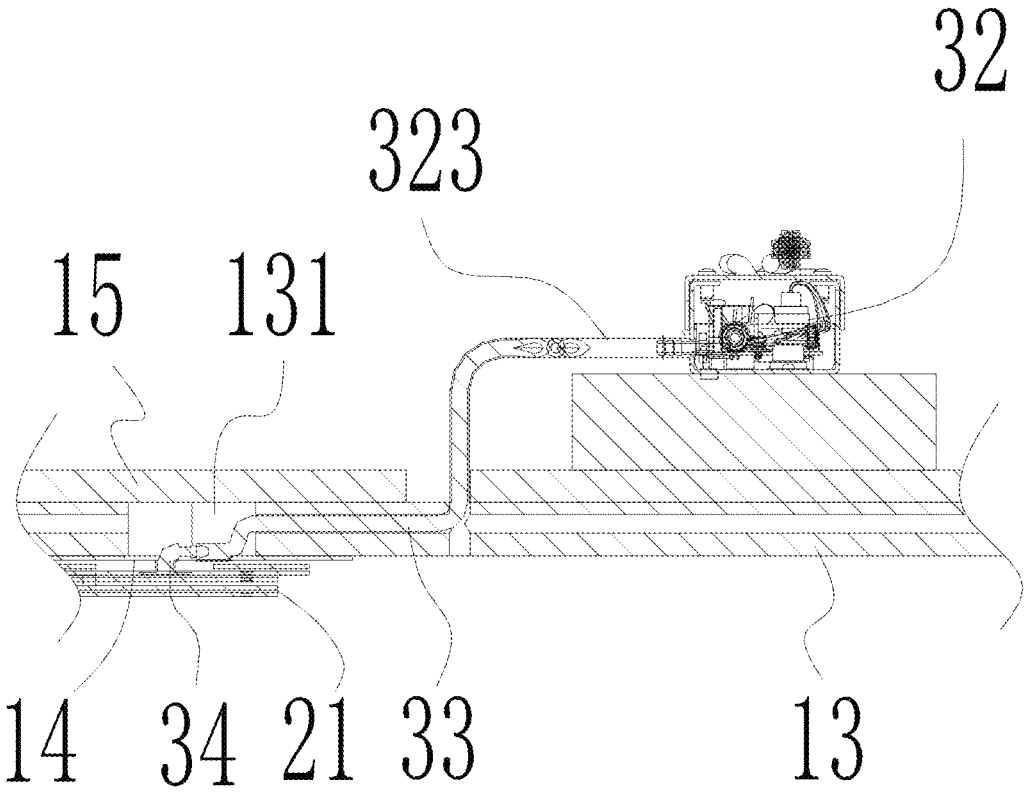
FIG. 12 is an enlarge view of a local area of FIG. 11.

As shown in FIGS. 8 to 10, in the technical scheme of the present embodiment, the valve 32 includes a plurality of air outlets 323. The air outlet tubes 33 are plural and disposed corresponding to the plurality of air outlets 323 in one-to-one manner. In this way, the plurality of air outlet tubes 33 can be controlled by one valve 32, resulting in a compact structure. Specifically, the valve 32 includes solenoid valves 321. Each solenoid valve 321 includes an air inlet and the plurality of air outlets, so that automatic control can be easily realized. For example, a control component is further included in the present embodiment. The solenoid valve 321 is connected to the control component. The arrangement of the control component makes the human body feel better and the airbag assembly 20 more uniform. As another embodiment, a plurality of branch outlets are disposed on a sidewall of a main tube. The branch outlets are connected to the solenoid valves 321 respectively. Each of the solenoid valves 321 is connected to an air outlet tube 33 in communication with an airbag 21.

Figure 5:
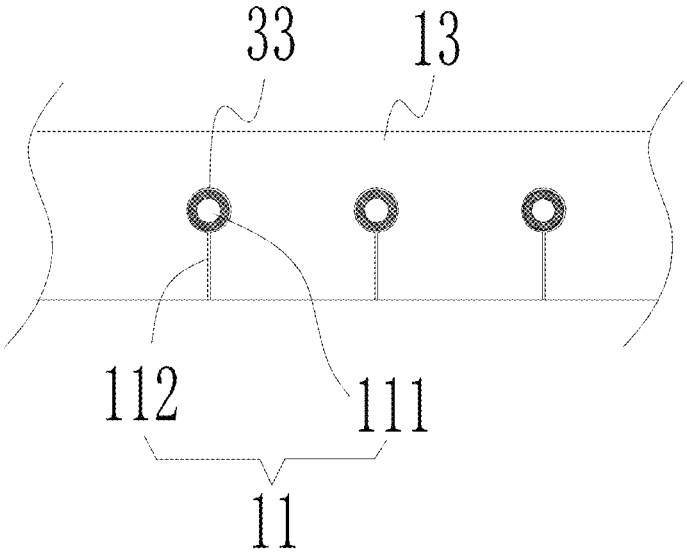
FIG. 5 is an enlarge view of a local area of FIG. 4.
Figure 6:
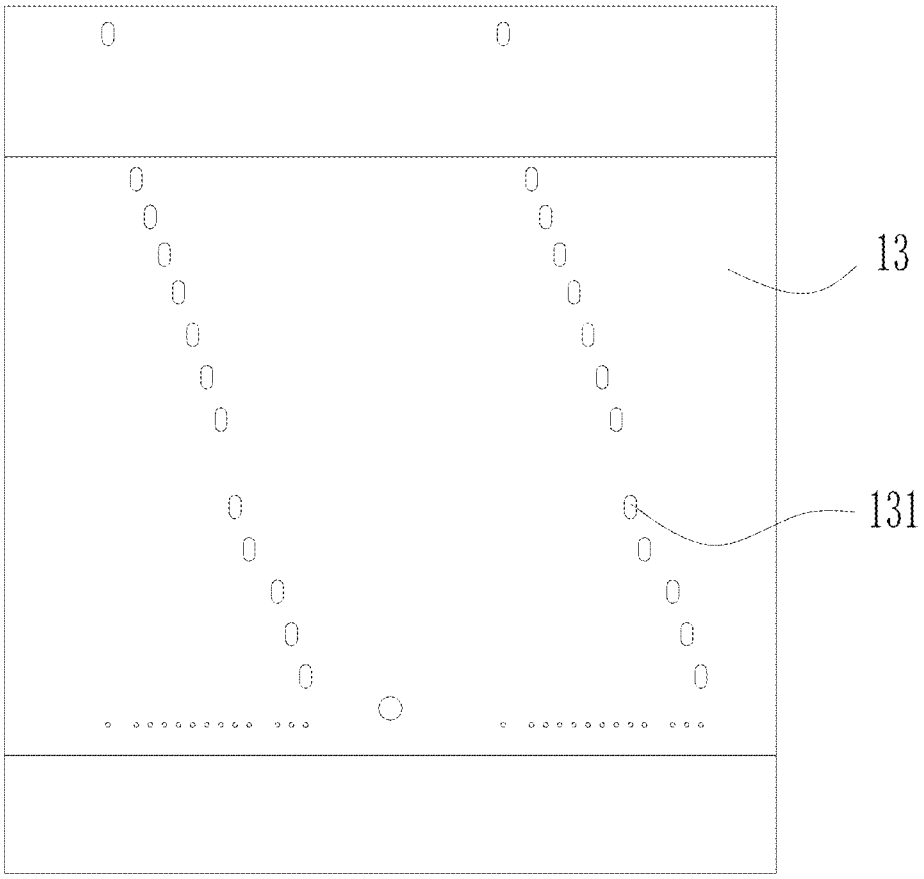
FIG. 6 is a schematic bottom view of the sponge support layer of FIG. 3.

As shown in FIGS. 5 and 8, in the technical scheme of the present embodiment, the support layer assembly 10 includes the sponge support layer 13. The sponge support layer 13 is located on the support layer body 15. The pipeline channels 11 are defined in the middle portion in the thickness direction of the sponge support layer 13. The pipeline channels 11 are defined in the middle portion in the thickness direction of the sponge support layer 13, and the air outlet tubes 33 are arranged in the pipeline channels 11, so that the air outlet tubes 33 are not easy to be exposed out. When the valve is disposed in the support layer body 15, the sponge support layer 13 is provided with downward extension holes. The extension holes are in communication with both the pipeline channels 11 and the accommodating space 12. During assembling, the valve 32 abuts against the sponge support layer 13 and is fixed to the sponge support layer 13 by means of glue or by other bonding methods, so that the air outlet tubes 33 are not prone to misalignment. In the present embodiment, the sponge support layer 13 is made of sponge. Certainly, the sponge support layer 13 can be made of other materials.

Figure 7:
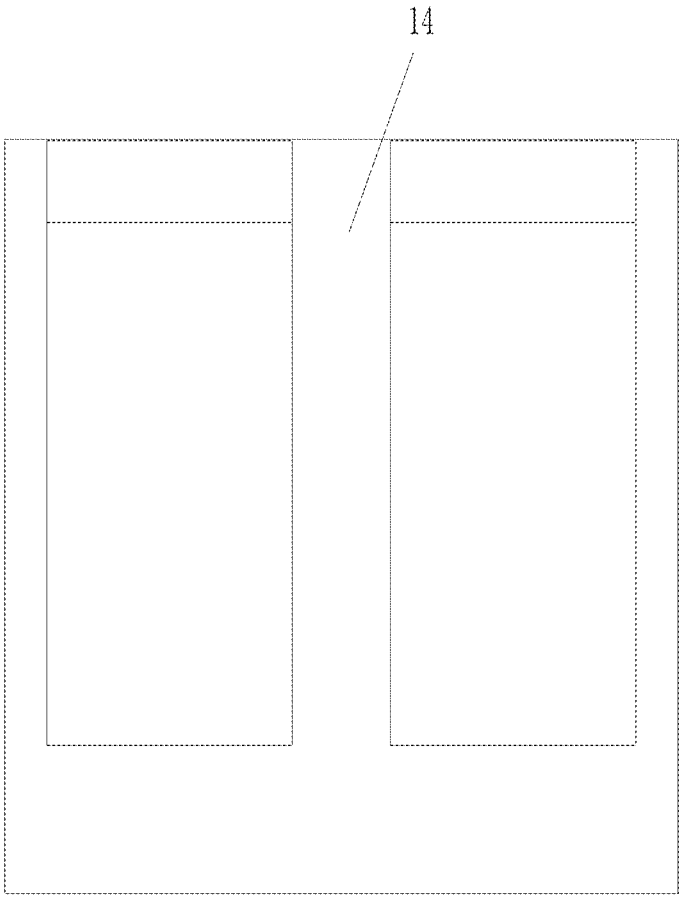
FIG. 7 is a schematic top view of an airbag support layer of FIG. 1.

As shown in FIGS. 1 and 7, in the technical scheme of the present embodiment, the mattress further includes an airbag support layer 14. The airbag support layer 14 is disposed between the sponge support layer 13 and the airbag assembly 20. The airbag support layer 14 is provided with second through holes 141. The second through holes 141 connect the airbag assembly 20 and the sponge support layer 13. The second through holes 141 correspond to upward through holes, i.e., first through holes 131, extending from the longitudinal holes 111 defined in the sponge support layer 13, which facilitates the communication between the airbag assembly 20 and the pipeline assembly 30. It should be noted that the air outlet tubes 33 of the pipeline assembly 20 at this position does not need to be bent, and the communication can be realized by connecting elbows, which can minimize the impact of the curvature due to the bending of the air outlet tubes 33. The arrangement of the airbag support layer 14 well protects the air outlet tubes 33 from exposing out from the longitudinal slits 112, being misaligned, or deforming. The airbag support layer 14 is bonded to the sponge support layer 13 by glue. As another embodiment, the airbag support layer 14 can be bonded to the sponge support layer 13 by Velcro.

As shown in FIGS. 3 to 6, in the technical scheme of the present embodiment, the pipeline channels 11 include a plurality of longitudinal holes 111 corresponding to the plurality of air outlet tubes 33. The longitudinal holes 111 extend in the length direction of the mattress, and are arranged in sequence in the width direction of the mattress. The arrangement of the plurality of longitudinal holes 111 can ensure that the air outlet tubes will not affect each other. The longitudinal holes 111 being arranged in sequence in the width direction of the mattress can ensure that the stress on the mattress is relatively balanced. It should be noted that each of the airbags in the airbag assembly 20 includes an air inlet nozzle. The air inlet nozzle is arranged at the bottom of the airbag. The air inlet nozzles of the airbags of the same airbag assembly 20 are arranged in sequence corresponding to the longitudinal holes 111 respectively, which eliminates the need for crossings, bends, etc., of the air outlet tubes 33. The above arrangement and placement prolong the service life and reduce maintenance costs.

As shown in FIG. 5, in the technical scheme of the present embodiment, the longitudinal slit 112 is defined between each of the longitudinal holes 111 and the top or bottom surface of the sponge support layer 13. Since the sponge support layer 13 is clastic, the air outlet tubes 33 can be pressed into the longitudinal holes 111. The arrangement of the longitudinal slits 112 facilitates mounting of the air outlet tubes 33. The starting position of the longitudinal slit 112 is the same as the starting position of the longitudinal hole, and the end position of the longitudinal slit 112 is the same as the end position of the longitudinal hole. The arrangement of such a longitudinal slit 112 not only ensures the mounting convenience, but also can ensure that the sponge support layer 13 is less damaged, so that the sponge support layer 13 can ensure both comfort and endurance performance.

As shown in FIG. 8, in the technical scheme of the present embodiment, the valve 32 abuts against the support layer assembly 10, so that the air outlets 323 of the valve 32 are correspondingly located in the longitudinal holes 111 respectively. This configuration makes the fixation more stable. Specifically, circumferential outer walls of the branch outlets of the valve 32 are bonded to the support layer assembly 10. It should be noted that the valve 32 can abut against the openings of the horizontal longitudinal holes 111. When the longitudinal hole 111 includes the extension hole extending from the longitudinal hole 111, having a downward-facing opening, the branch outlets of the valve 32 abut against the extension holes of the longitudinal holes 111.

As shown in FIG. 5, in the technical scheme of the present embodiment, each of the air outlet tubes 33 is in interference fit with the corresponding longitudinal hole 111. Such fitting structure is compact and easy to mount. Certainly, each of the air outlet tubes 33 can be fixed to the longitudinal hole 111 by bonding. The friction surface between the air outlet tube 33 and the corresponding longitudinal hole 111 is relatively large, and thus the friction force is relatively great. The interference fit between the air outlet tube 33 and the longitudinal hole 111 further ensures that the air outlet tube 33 does not easily misalign. It should be noted that a cross section of the longitudinal hole 111 can be in an oval shape, and a cross section of the air outlet tube 33 is also in an oval shape corresponding to the oval shape of the cross section of the longitudinal hole 111. Such a structure can prevent the misalignment during mounting and rotation of the air outlet tube. It should be noted that the longitudinal hole 111 can be alternatively provided with a rotation plane. For example, the cross section of the longitudinal hole 111 is in a pentagon shape, and the cross section of the air outlet 323 is also in a pentagon shape corresponding to the cross section of the longitudinal hole 111. Certainly, it is also possible that the cross section of the longitudinal hole 111 has only one plane.

In the technical scheme of the present embodiment, as shown in FIG. 9, an axis of the air inlet 322 of the valve 32 is perpendicular to an axis of each of the air outlets 323 of the valve 32. The valve 32 is provided with a bent portion. A portion of the air outlet tube 33 at this position does not need to be provided with a bent portion for cooperation. Such a structure is compact.

As shown in FIGS. 11 to 14, in the technical scheme of the present embodiment, the airbag assembly 20 includes a plurality of airbags 21. Each airbag 21 extends in the length direction of the mattress. The air inlet nozzles of the airbags 21 are spaced at predetermined distances in the width direction of the mattress. In this way, the air inlet nozzles of the airbag assembly 20 do not affect one another, and the force on the mattress is more balanced. The pipeline assembly 30 further includes a plurality of elbows 34. First ends of the elbows 34 are respectively in communication with the air outlet tubes 33, and second ends of the elbows 34 are respectively in communication with the airbags 21. The airbags 21 of the same airbag assembly 20 are flush with each other in the width direction of the mattress.

Figure 13:
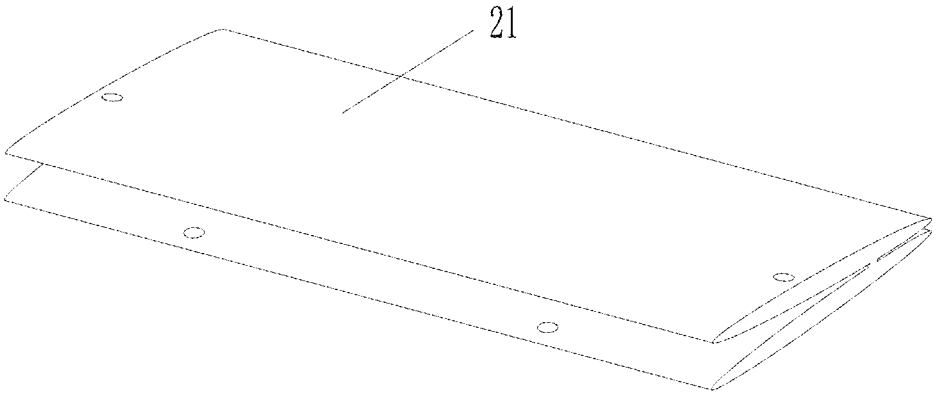
FIG. 13 is a schematic perspective view of an airbag of the mattress of FIG. 1.
Figure 14:
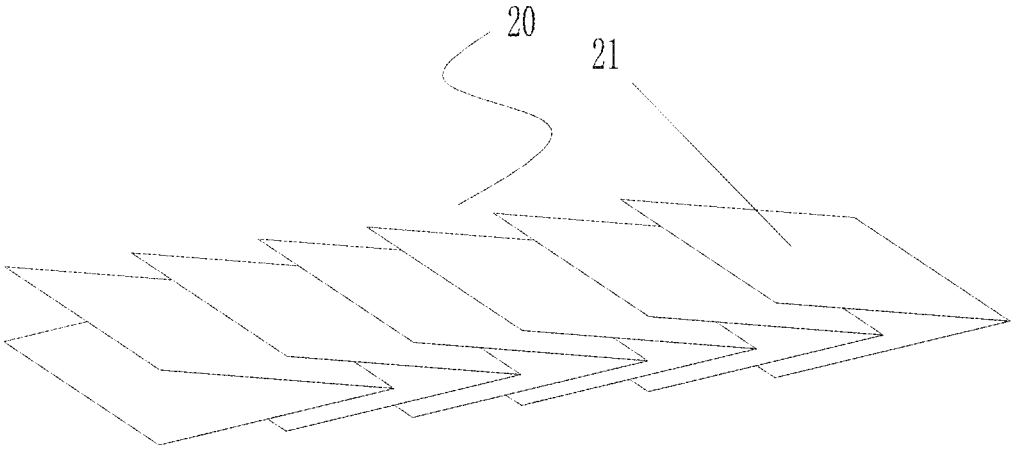
FIG. 14 is a schematic perspective view of an airbag assembly of the mattress of FIG. 1.
Figure 15:
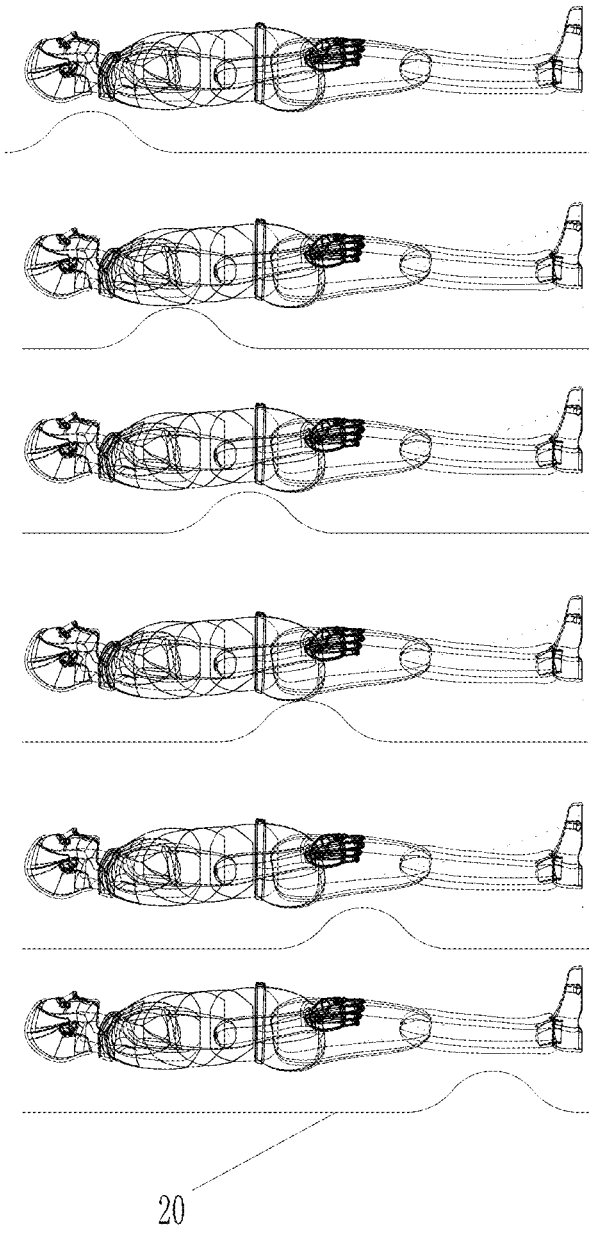
FIG. 15 is a schematic view of a working process of the airbag assembly of the mattress of FIG. 1.

As shown in FIGS. 13 and 14, in the technical scheme of the present embodiment, the airbag 21 includes a plurality of sub-airbags and a connecting part. The sub-airbags are stacked on one another. The connecting part is disposed between adjacent sub-airbags to communicate the sub-airbags. The airbag 21 includes the plurality of sub-airbags (includes two sub-airbags in the figure), and the sub-airbags are in communication with one another through the connecting part, so that when one of the sub-airbags is inflated, air can also enter the other sub-airbags. The sub-airbags are stacked on one another, and such an airbag structure can increase the height of the airbag after being inflated, without the need for increasing the width of the airbag to increase the height of the airbag. The above structure does not require a change of the structure of the mattress or the bed, and the height of the airbag can be increased.

It should be noted that the sub-airbags are stacked in the thickness direction of the bed. In the present embodiment, they are stacked on the top. The connecting part has a preset extension distance in the thickness direction of the bed, which facilitates the arrangement and combination of the airbags when used in combination. For example, the plurality of airbags are combined together in a clamped manner. The sub-airbags according to the present embodiment are not stacked in a simple stacking manner. In the present embodiment, the sub-airbags and the connecting part are integrally formed, or are connected and fixed by bonding, riveting, sewing, welding or other methods.

As shown in FIG. 13, in the technical scheme of the present embodiment, when the airbag is in a fully inflated state, a height of a first side of the airbag is greater than that of a second side of the airbag. Such an airbag facilitates subsequent combination arrangement, such as stacking of the plurality of airbags, or clamping arrangement of the plurality of airbags. The comfort level of the human body can be improved by the combination arrangement of the airbags. In addition, with the combination arrangement of the airbags, the airbags may be arranged more flexibly, satisfying the needs of human bodies of different weights, different genders, and different heights. The airbag having the first side greater in height than the second side of the airbag may be implemented in various ways, for example, by tilting the second sub-airbag upward.

As shown in FIG. 13, in the technical scheme of the present embodiment, a first side of the connecting part is greater in length than a second side of the connecting part. The first side of the connecting part is consistent with the first side of the airbag. The second side of the connecting part is consistent with the second side of the airbag. The airbag having a height at the first side greater than that at the second side of the airbag may be implemented in various ways, and in this embodiment, is realized by having the length of the first side of the connecting part greater than the length of the second side of the connecting part. This structure facilitates the combination arrangement of the plurality of airbags. For example, another airbag can be placed into the gap between the sub-airbags. The first side of the connecting part specifically refers to the front side of the connecting part, and the second side of the connecting part specifically refers to the rear side of the connecting part. The height of the airbag decreases linearly along the direction from the front side to the rear side of the connecting part. As can be appreciated by those skilled in the art, when two sub-airbags are provided, one connecting part is provided; when three sub-airbags are provided, two connecting parts are provided; when four sub-airbags are provided, three connecting parts are provided, and so on, which will not be repeated herein.

As shown in FIG. 13, in the technical scheme of the present embodiment, the distance between the connecting part and the first side of the airbag is greater than or equal to the distance between the connecting part and the second side of the airbag. Such a structure enables a larger cooperation area among the plurality of airbags when combined, and the cooperation between airbags is stable.

As shown in FIG. 13, in the technical scheme of the present embodiment, the length from the connecting part to the second side of the airbag accounts for ⅛ to ½ of the length from the first side of the airbag to the second side of the airbag. Such airbags 21 when combined can cooperate more stably. For example, when the airbag 21 is clamped by another airbag, the cooperation area is relatively large. In some embodiments, the length from the connecting part to the second side of the airbag accounts for ¼ to ⅓ of the length from the first side of the airbag to the second side of the airbag.

It should be noted that in the present specification, relational terms such as "first" and "second" are only used to distinguish one entity or operation from another entity or operation, and do not necessarily require or imply that there is an actual relationship or sequence between the entities or operations. Furthermore, the terms "comprising", "including" or any other variants thereof are intended to cover a non-exclusive inclusion, so that a process, method, article, or device that includes a list of elements includes not only those elements, but also other elements not expressly listed, or elements inherent in the process, method, article or device. Without further limitation, an element modified by a phrase "comprising a . . . " does not exclude the presence of additional identical elements in a process, method, article, or device that includes the stated element.

The above descriptions are only specific embodiments of the present disclosure, enabling those skilled in the art to understand or implement the present disclosure. Various modifications to these embodiments will be readily apparent to those skilled in the art, and the generic principles defined herein may be practiced in other embodiments without departing from the spirit or scope of the present disclosure. Therefore, the present disclosure is not to be limited to the embodiments described herein, but shall be subjected to the widest scope consistent with the principles and novel features claimed herein.

What is claimed is:

1. A mattress, comprising:

a support layer assembly comprising pipeline channels embedded therein;

an airbag assembly located on top of the support layer assembly; and a pipeline assembly at least partially extending through the pipeline channels and in communication with the airbag assembly;

wherein the pipeline channels comprise a plurality of longitudinal holes; the pipeline assembly comprises a valve, the valve comprises a plurality of air outlets, and the valve abuts against the support layer assembly such that the plurality of air outlets of the valve are located in the plurality of longitudinal holes respectively.

2. The mattress according to claim 1, wherein the support layer assembly comprises a sponge support layer, the pipeline channels are defined in the sponge support layer.

3. The mattress according to claim 2, wherein the plurality of longitudinal holes extend in a length direction of the mattress, and are arranged in sequence in a width direction of the mattress.

4. The mattress according to claim 3, wherein a longitudinal slit is defined between each of the plurality of longitudinal holes and a top surface of the sponge support layer.

5. The mattress according to claim 3, wherein the pipeline assembly comprises a plurality of air outlet tubes disposed in the plurality of longitudinal holes in one-to-one manner.

6. The mattress according to claim 5, wherein the pipeline assembly further comprises an air inlet tube, the air inlet tube is connected to an air inlet of the valve, a first end of each of the plurality of air outlet tubes is connected to an air outlet of the valve, and a second end of each of the plurality of air outlet tubes is connected to the airbag assembly.

7. The mattress according to claim 6, wherein the support layer assembly comprises a support layer body located at a side of the sponge support layer away from the airbag assembly, the support layer body comprises an accommodating space, and the valve is disposed in the accommodating space.

8. The mattress according to claim 7, wherein the valve further comprises one air inlet, and the plurality of air outlet tubes are connected to the plurality of air outlets in one-to-one manner.

9. The mattress according to claim 6, wherein an axis of the air inlet of the valve is perpendicular to an axis of each of the plurality of air outlets of the valve.

10. The mattress according to claim 5, wherein the plurality of air outlet tubes is in interference fit with the plurality of longitudinal holes respectively.

11. The mattress according to claim 5, further comprising an airbag support layer disposed between the support layer assembly and the airbag assembly.

12. The mattress according to claim 1, wherein the airbag assembly comprises a plurality of airbags extending in a length direction of the mattress, and predetermined distances are formed between air inlet nozzles of the plurality of airbags in a width direction of the mattress.

13. The mattress according to claim 1, wherein the airbag assembly is a plurality of airbag assemblies, and the pipeline assembly is a plurality of pipeline assemblies corresponding to the plurality of airbag assemblies.

14. A bed, comprising the mattress according to claim 1.

15. A mattress, comprising:

a support layer assembly comprising pipeline channels embedded therein;

an airbag assembly located on top of the support layer assembly; and a pipeline assembly at least partially extending through the pipeline channels and in communication with the airbag assembly;

wherein the support layer assembly comprises a sponge support layer, the pipeline channels are defined in the sponge support layer; the pipeline channels comprise a plurality of longitudinal holes, the plurality of longitudinal holes extend in a length direction of the mattress, a longitudinal slit is defined between each of the plurality of longitudinal holes and a top surface of the sponge support layer, a starting position of the longitudinal slit is located corresponding to a starting position of the each of the plurality of longitudinal holes, and an end position of the longitudinal slit is located corresponding to an end position of the each of the plurality of longitudinal holes.

16. A mattress, comprising:

a support layer assembly comprising pipeline channels embedded therein;

an airbag assembly located on top of the support layer assembly; and a pipeline assembly at least partially extending through the pipeline channels and in communication with the airbag assembly;

wherein the pipeline channels comprise a plurality of longitudinal holes, the plurality of longitudinal holes extend in a length direction of the mattress, and the pipeline assembly comprises a plurality of air outlet tubes disposed in the plurality of longitudinal holes in one-to-one manner.

* * * * *